US008207448B2

(12) United States Patent
Hui

(10) Patent No.: US 8,207,448 B2
(45) Date of Patent: Jun. 26, 2012

(54) ELECTRICALLY CONDUCTIVE BUOYANT CABLE

(75) Inventor: Wing-kin Hui, Hong Kong (HK)

(73) Assignee: Multi Wisdom Limited, Hong Kong (HK)

( * ) Notice: Subject to any disclaimer, the term of this patent is extended or adjusted under 35 U.S.C. 154(b) by 0 days.

(21) Appl. No.: 12/100,409

(22) Filed: Apr. 10, 2008

(65) Prior Publication Data

US 2008/0296040 A1 Dec. 4, 2008

(51) Int. Cl.
*H01B 7/00* (2006.01)

(52) U.S. Cl. ..... 174/120 R

(58) Field of Classification Search ..... 174/110 F, 174/120 R

See application file for complete search history.

(56) References Cited

U.S. PATENT DOCUMENTS

| | | | | |
|---|---|---|---|---|
| 3,155,768 | A * | 11/1964 | Garshick | 174/101.5 |
| 3,280,652 | A * | 10/1966 | Eckhardt | 74/502.3 |
| 3,516,859 | A * | 6/1970 | Heinz et al. | 427/118 |
| 3,605,398 | A * | 9/1971 | Carlson et al. | 57/217 |
| 4,330,685 | A * | 5/1982 | Bleikamp, Jr. | 174/101.5 |
| 4,399,322 | A * | 8/1983 | Hafner, Jr. | 174/101.5 |
| 6,753,478 | B2 * | 6/2004 | Rodway et al. | 174/120 R |
| 2006/0178063 | A1 * | 8/2006 | Dupre | 441/133 |

* cited by examiner

*Primary Examiner* — Chau Nguyen

(74) *Attorney, Agent, or Firm* — Peninsula IP Group; Douglas Charkin

(57) ABSTRACT

Disclosed herein is an electrically conductive buoyant cable. The cable includes an electrical conductor member having at least one electrical conductor. The cable also includes a filler layer that consists of buoyant materials with relative density lower than 1. The filler layer surrounds and encloses the electrical conductor member. The invention includes a jacket, which, in one embodiment, contains a small quantity of filler material or no filler material. The jacket surrounds the filler layer. In one embodiment, the filler layer and the jacket are made of the same material.

9 Claims, 3 Drawing Sheets

ELECTRICALLY CONDUCTIVE BUOYANT CABLE

FIELD OF THE INVENTION

This invention relates to an electrically conductive cable, in particular an electrically conductive buoyant cable.

TECHNICAL BACKGROUND

An electrically conductive buoyant cable is an electrical cable having a relative density below 1. The cable typically includes one or more conductors. Because the relative density of the electrically conductive buoyant cable is below 1, it will float on the surface of the water. In cases of interest in this application, the electrically conductive buoyant cable is connected to a mechanical device, which used for underwater applications, such as a pool cleaning device. The electrically conductive buoyant cable is used to provide an electrical power source to the pool cleaning device. Using the cable, it will be appreciated that a major part of the cable floats on the water. The remaining part of the cable runs between the cleaning device at the bottom of the water and the water surface.

The above described electrically conductive buoyant cable will not stay totally under the water. Remaining totally under water would hinder the normal performance of the cleaning device. For example, the cable could become entwined with the cleaning device preventing the device from moving along the pool surface.

As a result of the cable being buoyant, it will not rest upon the floor of the pool having water in it.

An additional advantage of the cable being buoyant is that it will not become entwined with obstacles on the floor of the pool while the pool has water in it. If a non-buoyant cable were used and rested at the bottom of the water, it would cause a great amount of tension to be exerted the cable. In fact, such a cable could reach its maximum value and break. Such breakage would cause the cable to cease to be able to perform its function.

Additionally, the electrically conductive buoyant cable must have a certain flexibility. Otherwise, the working area of the pool cleaning device will be greatly limited. Also, the moving speed and moving direction of the device will be affected. FIG. 1 shows the analysis of the forces exerted on the electrically conductive buoyant cable during work. During operation, the electrically conductive buoyant cable may be affected by torque, pressure and tension exerted by outside obstacles. In order to prevent these forces from damaging the electrically conductive buoyant cable, improvements are needed. They discover and use cable with smaller relative density, better flexibility and higher tension resistance capability.

FIG. 2 shows a sectional view of an electrically conductive buoyant cable of the prior art. A filler layer 21 is located between a jacket 22 and a fiber layer 23. There is also a filler layer 21 between the fiber layer 23 and the conductor 24. The filler layer has a relative density lower than 1. This is, in fact, how the electrically conductive buoyant cable has a relative density lower than 1 and is able to float on the water. The fiber layer 23 is made of fibers, which are used to withstand the tensile force exerted on the electrically conductive buoyant cable. The conductor 24 is a pair of the electrically conductive buoyant cables. The conductor 24 includes a pair of electrical wires, which are typically straight or twisted. The conductor 24 additionally contains water-proof and insulating material for good protection.

FIG. 2 shows other examples of known electrically conductive buoyant cables. As described below, there are typically three types of known cables.

In one example, a soft hollow tube encloses the conductor. Thus, with the same mass, the volume of the electrically conductive buoyant cable increases. Therefore, it has increased buoyancy. However, the hollow part of this kind of electrically conductive buoyant cable does not contain any components to withstand pressure. The electrically conductive buoyant cable will deform once there is sufficient outside pressure. This deformation leads to a decrease in the volume of the cable and thus causing the cable to lose buoyancy. Also, the jacket 22 and the filler layer 21 of this buoyant cable example are made of different materials. Using different materials increases the likelihood that there will be layer separation.

In this example, the electrically conductive buoyant cable will easily deform when it is subjected to certain types of torque. Once the cable starts to deform, all the deformation will focus on the part, which deforms the earliest. As a result, the electrically conductive buoyant cable will fold itself and irreversibly deform. Furthermore, using a cable of this construction increases the likelihood that water will leak into the soft hollow tube damaging all or part of the cable. Such leakage will consequently lead to loss of buoyancy of the entire cable.

In this example of the buoyant cable, the soft hollow tube and the conductor enclosed in the tube are separate. When the electrically conductive buoyant cable is subject to a tensioning force, the force received by the tube and the conductor will be different. The reaction of each element is therefore also different. So, there will likely be layer separation and the cable causing the cable to become irreversibly deformed after the tensioning force.

In another example of the electrically conductive buoyant cable, foaming plastic or rubber material is used to surround the conductor. Such material is used to increase the buoyancy of the buoyant cable. The use of foaming plastic or rubber material with air pockets to increase buoyancy typically lowers the tensile resistance the cable. In normal operation, the cable will be subjected to a higher tension force during the extension and withdrawal actions of placement and removal of the pool cleaning device from the pool, respectively.

When in use, the cable must withstand pressure when deep under water. In these situations, the cable may collapse and deform because of its cable construction having a foaming material. The cable may therefore become damaged when deep under water. There also exists here the problem of layer separation in this example as well.

In the next example of the electrically conductive buoyant cable, the plastic material is mixed with micro-spheres and is wrapped around the coaxial cable. Plastic or other insulating material of low relative density is used to make the jacket of this electrically conductive buoyant cable. This cable has a better buoyancy capability and higher tension resistance capability. However, fusion is not possible between the plastic and the micro-spheres. The junction between them can only withstand limited ripping force. If that limit is exceeded, there will likely be layer separation.

Additionally, in this example, there is a saturation point where further increase quantity of micro-spheres is not possible. Generally, known technology makes it difficult to have more than 40% by volume of micro-spheres embedded in plastic material. One drawback of this construction is that the diameter of the cable as well as the thickness of the buoyant material is increased. Additionally, the flexibility of the cable, especially its ability to bend is reduced. The micro-spheres are embedded in the jacket of the cable, which is made of the plastic or insulating material. Furthermore, the construction consistent with the above, weakens the physical properties of the cable jacket. Such weakening may cause the jacket to be unable to resist abrasion and become torn.

The electrically conductive buoyant cables mentioned above consists of a multi-layers structure, made from different materials. During the manufacturing process, it is needed to compress several times in order to finish the production of an entire cable. This leads to higher than necessary manufacturing costs.

The invention of the buoyant tether cable (the U.S. Pat. No. 4,110,554) relates to another multi-layered buoyant tether cable. FIG. 3 shows the sectional view of the buoyant tether cable of the invention. The buoyant tether cable consists of a circular jacket (31) and a center stress core (32) has a plurality of stress bearing elements (3221) contained within a core tape binder (321). There are three pairs of conductor elements including a first pair (33), a second pair (34) and a third pair (35) and additional conductor element (36). All the above elements twine around the central stress core. The three pairs of conductor elements (33), (34) and (35) can be identical.

The center stress core (32) has six stress bearing elements (322) contained within a core tape binder (321). Six stress bearing elements (322) are cabled around a central core element (322) in a six around one configuration. The central core element (322) is arranged on the longitudinal axis of the entire buoyant tether cable. Each stress-bearing element is preferably composed of three-stress bearing members twisted among themselves which are, in turn, contained within a jacket (321). This arrangement provides a tension bearing capability to the buoyant tether cable.

The conductor core (332) of each conductor element in each of the pairs of conductor elements (33), (34) and (35), can be a hollow low density, high strength plastic for increased buoyancy. Cabled around the conductor element core (332) are five insulated, twisted pairs of conductive wires (334). The conductor core (332) and the five conductive wires (334) are enclosed by the low-density, high strength plastic-like conductor tape binder (331).

The circular jacket (31) circumferentially surrounds the plurality of conductor elements which are cabled around the center stress core (32). Accordingly, interstices (37) are formed between the center stress core (32) with the conductor elements (33), (34), (35) and (36) and the outer circular jacket (31). Interstices (37) are substantially filled with a quantity of micro-spheres in a silicone oil medium, so as to increase the buoyancy of the buoyant tether cable.

In the interstices (37) nearer to the circular jacket (31) are seven interstitial stress members (38). Each interstitial stress member (38) contains at least two stress-bearing members (382) twisted between or among themselves and cabled within the interstices (37) and enclosed in a jacket (381) of a high strength, low density plastic-like material similar to the circular jackets (3221).

This buoyant tether cable contains a honeycomb structure. The buoyancy of the cable is increased. The pressure and tension resistance capability is also increased. The cable will not easily deform. However, the flexibility of this buoyant tether cable is poor. The cable consists of a multi-layered structure, which is made of different materials. Also, micro-spheres are added into the filler layer. Once the buoyant tether cable is being twisted, it will not be able to withstand the torque. The cable will be damaged and deformed, and the problem of layer separation may easily happen. Since the structure of this cable is rather complicated, the manufacturing procedure will be complicated and the manufacturing cost will also be high.

The invention of the floating cable (Chinese patent CN01279396) relates to a floating cable. FIG. 4 shows a sectional view of this new floating cable. The floating cable includes a coaxial wire (40), twisted wires (41) and a silk rope (42). They are enclosed by a frothy polyethylene (43). The frothy polyethylene (43) is enclosed by a light and heat resisting polyethylene protection layer (44). The coaxial wire (40) is made of the high-tension resistance copper core layer (404), the low density insulating polyethylene layer (403), the high-tension resistance copper cover layer (402) and the light and heat resisting polyethylene protection layer (401). The order of the components are arranged from inside to outside, which means the copper wire layer is the inner layer while the protection layer is the outer layer. The twisted wires (41) consists of high-tension resistance copper core layer (414) at the inside and the low density insulating polyethylene layer at the outside (413). Their outer layers consist of polyester cover (412) at the inside and light and heat resisting polyethylene protection layer (411) at the outside.

This floating cable consists of a multi-layered structure and different layers are made of different materials. There are infusible materials located far away from the central axis of the floating cable. When the cable is twisted or bent, fusion cannot occur between the two neighboring layers of different materials. The polyester cover layer (412) cannot fuse with the neighboring light and heat resisting polyethylene protection layer (411). The low density insulating polyethylene layer (413) cannot fuse with the neighboring polyester cover layer (412). The low density insulating polyethylene layer (413) cannot fuse with the neighboring high-tension resistance copper core layer (414). The high-tension resistance copper cover layer (402) cannot fuse with the neighboring light and heat resisting polyethylene protection layer (401). The low density insulating polyethylene layer (403) cannot fuse with the neighboring high-tension resistance copper cover layer (402). The high-tension resistance copper core layer (404) cannot fuse with the neighboring low density insulating polyethylene layer (403). The silk rope (42) cannot fuse with the neighboring frothy polyethylene layer (43). This leads to the phenomenon of layer separation. Moreover, the manufacturing procedures will be complicated and the manufacturing cost will be high due to the multi-layered structure of the floating cable.

The prior art while useful has been shown to have certain defects during applications. Improvements are therefore needed.

SUMMARY OF THE INVENTION

According to the mentioned disadvantages of the known devices, it is a general object of the buoyant cable in accordance with this invention to provide an electrically conductive buoyant cable having better buoyancy, greater flexibility and the ability to resist higher tensioning forces. At the same time, it is an object of the cable in accordance with the invention to not easily deform and to avoid layer separation.

According to the cable of the current invention, the jacket and the neighboring filler layers are made from the same or similar materials. Using this construction, it is an object of the cable of this invention to be able to have the two layers fuseable.

According to the current invention, the buoyant material of the filler layer is chosen to increase the buoyancy and the tensile resistance of the cable.

According to the current invention, the conductor will be located at the central axis of the electrically conductive buoyant cable. This decreases the load of the bending force on the cable. The tension bearing fiber layer will be surrounding the conductor. This increases the resistance of the electrically conductive buoyant cable towards tension forces.

In order to satisfy the objective of the invention, the current invention discloses an electrically conductive buoyant cable, which includes at least an electrical conductor. It also includes a filler layer which consists of buoyant materials having a relative density lower than 1. The filler layer encloses the electrical conductor. There is a jacket, which does not contain or only contains a small amount of filler material. It is located around the outer layer of the filler layer as mentioned above. The filler layer and the jacket are made of the same material.

The material of the jacket and the filler layer is plastic polyethylene, plastic polypropylene or soft plastic with shore hardness below A120.

The buoyant material of the mentioned filler layer is foam material and/or hollow glass micro-spheres.

The mentioned filler layer consists of buoyant materials made from the jacket material and mixed with foaming material or injected with air bubbles.

The mentioned filler layer consists of buoyant materials made from the jacket material and mixed with hollow glass micro-spheres.

The mentioned filler layer consists of buoyant materials made from the jacket material and mixed with the foam material, air bubble or hollow glass micro-spheres.

The mentioned foam material is foam material with tiny holes.

If the buoyant material of the mentioned filler layer consists of foam material or air bubbles, the jacket would be solid filled material.

The mentioned conductor is located at the center axis of the electrically conductive buoyant cable.

Furthermore, the mentioned electrically conductive buoyant cable includes a tensional fiber layer. This fiber layer twines around the conductor located at the center axis of the electrically conductive buoyant cable.

The tension bearing fiber of the mentioned tensional fiber layer tightly twines around the mentioned conductor.

If the electrically conductive buoyant cable consists of two or more groups of conductors, insulating layer will be added to the outer layer of every group of conductors.

The mentioned insulating layer is made of insulating oil.

The mentioned conductor is made of aluminum metal.

In order to achieve the objects of the invention, the current invention discloses an electrically conductive buoyant cable. The cable includes at least one electrically conductive member. The cable also includes a filler layer, which consists of buoyant materials with relative density lower than 1. The filler layer surrounds and encloses the electrical conductor. The cable includes a jacket surrounding the electrically conductive member. The outer layers, namely the filler and the jacket are made of the similar material and have melting points being approximately the same. Additionally, the materials of the jacket and the filler layer have high fusibility.

The filler layer and the jacket are made from two similar plastic materials. The difference between the melting point of the filler layer and the jacket is not greater than 30 degree Celsius.

It is an advantage of the electrically conductive buoyant cable of this invention to have better buoyancy, greater resistance to tensile stresses, increased flexibility and increased resistance to tension.

Another advantage of the cable in accordance with the invention herein is that it is requires a simple, low cost manufacturing process.

BRIEF DESCRIPTION OF THE DRAWING

For a further understanding of the objects and advantages of the present invention, reference should be made to the following detailed description, taken in conjunction with the accompanying drawing, in which like parts are given like reference numerals and wherein.

DETAILED DESCRIPTION OF THE INVENTION

Figure 1:
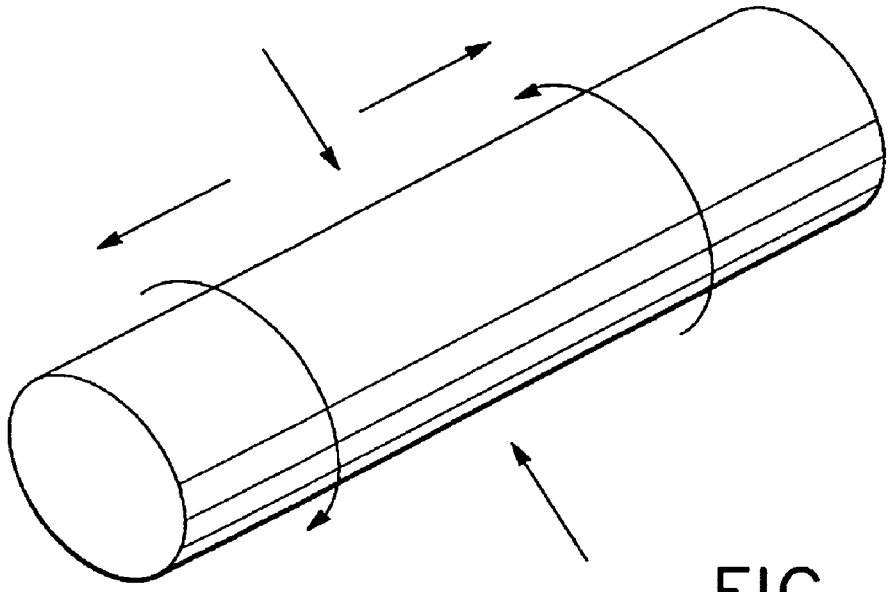
FIG. 1 is a perspective view illustrating the forces exerted on the electrically conductive buoyant cable during operation.
Figure 2:
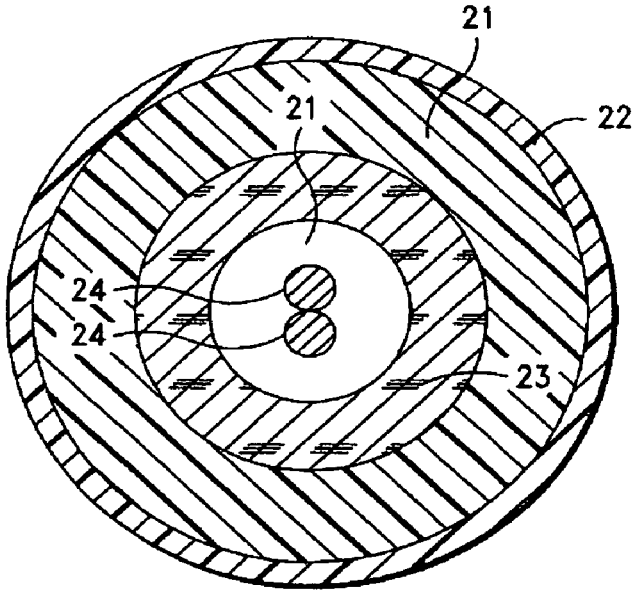
FIG. 2 (PRIOR ART)
FIG. 2 is a sectional view of an electrically conductive buoyant cable of prior art.
Figure 3:
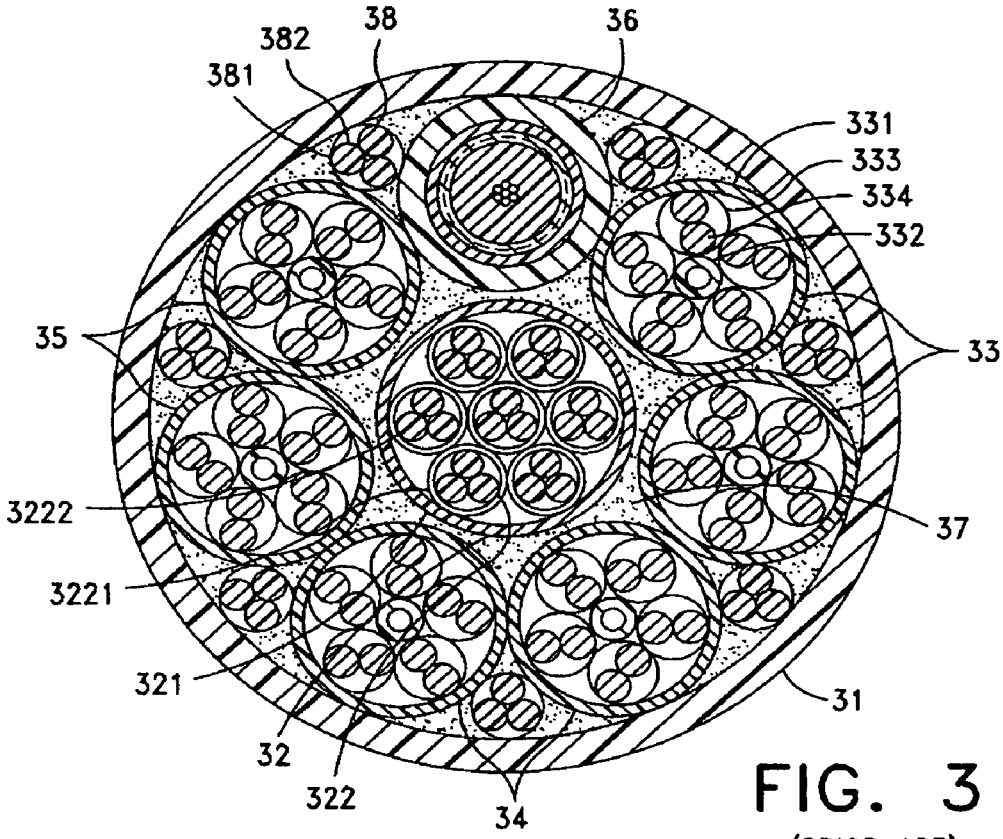
FIG. 3 (PRIOR ART)
FIG. 3 is a sectional view of another known electrically conductive buoyant cable.
Figure 4:
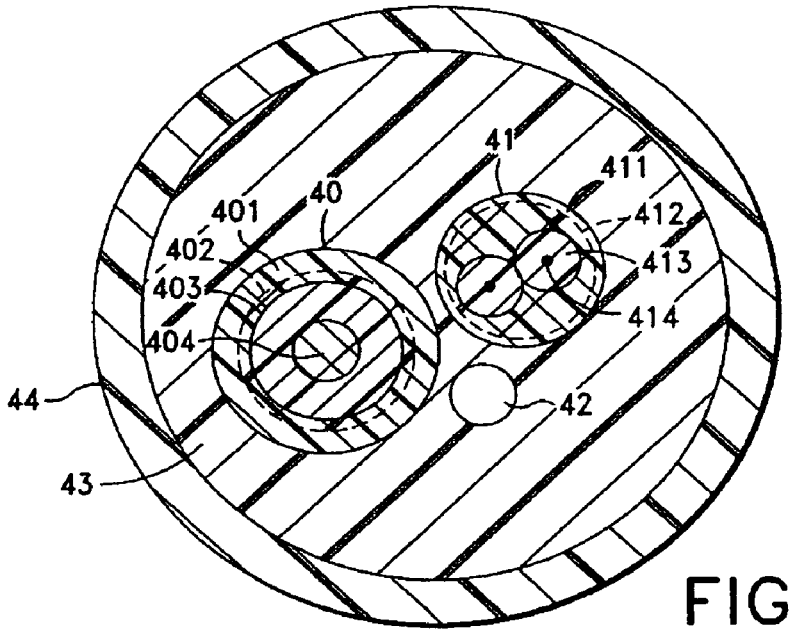
FIG. 4 (PRIOR ART)
FIG. 4 is a sectional view of another known electrically conductive floating cable.

To explain the objects and advantages of the swimming pool cleaning vehicle in accordance with the invention, the following description of the drawing and the exemplary embodiments are provided in detail. As will be appreciated by those skilled in the art the exemplary embodiments are provided to explain the swimming pool cleaning vehicle in accordance with the invention in detail and not to be used to limit its scope.

Figure 5:
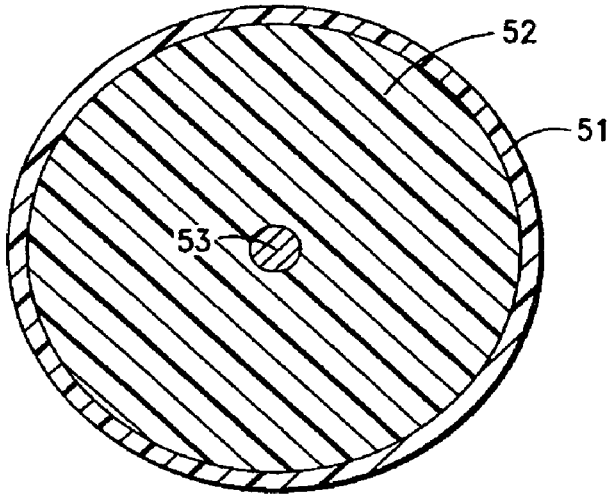
FIG. 5 is a sectional view of the electrically conductive buoyant cable in accordance with this invention.

FIG. 5 shows a sectional view of one embodiment of the electrically conductive buoyant cable in accordance with this invention in one embodiment. The details are described below.

The electrically conductive buoyant cable in accordance with this invention includes a jacket (51) which is located along the same longitudinal axis as the cable generally, a filler layer (52) and at least one conductor (53). The filler layer surrounds and encloses the conductor (53). The jacket (51) surrounds the filler layer (52).

In an exemplary embodiment the preferred material of the jacket (51) consists of no buoyant or filler material. However, under certain manufacturing processes, a small amount of filler is added into the jacket (51) creating another embodiment of the cable in accordance with this invention.

The filler layer (52) consists of filler material in order to increase buoyancy. The relative density of the filler material is lower than 1. In one exemplary embodiment, the jacket and the filler layer are made of the same material.

In the manufacturing process of the cable in accord with this invention, the jacket (51) is made after the filler layer (52) is formed. When the jacket (51) is being made, the jacket (51) in liquid or semi-liquid state is added to the filler layer (52), which has been solidified. The surface of the filler layer (52) has a higher melting point. It can melt the surface of the jacket (51) to a certain extent. Thus, fusion occurs. This ensures that the two layers can fuse with each other. In this embodiment, the jacket (51) and the filler layer (52) are known to be having good fusibility.

Many kinds of materials can be chosen to make the jacket (51) and the filler layer (52) such as polyethylene, polypropylene and plastic material with shore hardness below A120. Polypropylene and polyethylene are especially good because of their relative density below 1. Additionally, both compounds are water-proof and they are good at increasing the buoyancy of the electrically conductive buoyant cable.

The jacket and the filler layer of the electrically conductive buoyant cable of prior arts are made of different materials. Layer separation may exist when the cable is subjected to torque. This damages the electrically conductive buoyant cable. Except the material at the central axis or close to the central axis, the jacket (51) and the filler layer (52) are made of the same material. The jacket (51) and the filler layer (52) have good fusibility. This ensures that the jacket (51) binds tightly to the filler layer (52), and therefore avoids the problem of the layer separation. This also increases the cable resistance towards any torque force.

In the prior art, different kinds of methods are used to increase buoyancy of the electrically conductive buoyant cable. The current invention uses suitable buoyant material to fill up the filler layer (52) during the compressing process. This makes the filler layer with buoyancy. Air bubbles can be added to the plastic material to make the buoyant material have good buoyancy. In practice, the air bubbles are injected into the plastic material. The plastic material therefore includes the air bubbles. Physical or chemical methods can be used to include the air bubbles in the plastic material.

For the chemical method, a foam material is added to the plastic material. The foam material may either be closed-hole or opened-cell. For the closed-cell foam material, there is a screen separating the holes inside the foam material. The holes cannot connect to one another. In this embodiment, foam material is an independent hole structure with mainly small or very tiny holes. In the open-cell embodiment, the foam material cells are able to connect with one another.

One kind of closed-cell foam material is called fully-closed-cell foam. In this embodiment, the cable of this invention has better buoyancy as well as greater resistance to tension.

In an exemplary embodiment, foam material is used to make the filler layer (52) as well. The foam material used is the fully-closed-cell foam. An example of this made is called SAFOAM material and is made by the American Reedy International Corporation.

During the injection or compression process, a certain percentage of plastic particles and SAFOAM material are added to the general plastic material used to make the element. The mixture is then stirred well and heated to a certain temperature. As a result air bubbles generated are enclosed by the plastic material. The air bubbles generated are rather small in size. By varying the percentage of the SAFOAM material added, the relative density of the buoyant material can be varied.

For the physical method, a high pressure air jet is used to inject the high pressure air into the melting plastic material. Using this process air bubbles become trapped within the melting plastic. Either the chemical or the physical method can be used to make the plastic material. As will be appreciated, the filler material with air bubbles is still plastic material. And, it will be appreciated that this is the same material used for the jacket. If the filler layer is made by foaming method, harmless and non-poisoning gas is used.

In another exemplary embodiment, hollow glass spheres are added to the buoyant material used in the filler layer (52). The hollow glass spheres are hard. By adding the glass spheres, the cable has increased resistance to tension and especially great tension.

Adding the glass spheres, also increases the cable's buoyancy. If hollow glass spheres with diameter 10 to 100 um are used, the relative density of the material will be below 0.5. With the addition of suitable percentage of such glass spheres, the overall relative density of the cable is maintained below 1.

In another preferred embodiment, the buoyant material of the mentioned filler layer (52) is made of foam material and plastic material with hollow glass spheres added. Foam material and plastic material with hollow glass spheres are used to build up the filler layer. The ratio of the foam material and plastic material with hollow glass spheres is set according to the expected relative density and the maximum tension and pressure bearing capability.

As described above, the buoyant material of the filler layer (52) is made from foam material and in some embodiments includes a predetermined percentage of hollow glass spheres. In other embodiments, the filler layer (52) of the electrically conductive buoyant cable of this invention is made from material used for making the jacket. and buoyant material containing foam material or air bubbles.

In another embodiment, the filler layer (52) of the electrically conductive buoyant cable of this invention includes foam material, while the jacket (51) is made of the solid filling material. The jacket (51) and the filler layer (52) have good fusibility. In this embodiment, the foam material (filler layer 52) is added to surround the central axis and the solid filling material protection (jacket 51) is added to surround the surface of the foam material. The solid filling material protects the plastic against physical and chemical reactions.

Figure 6:
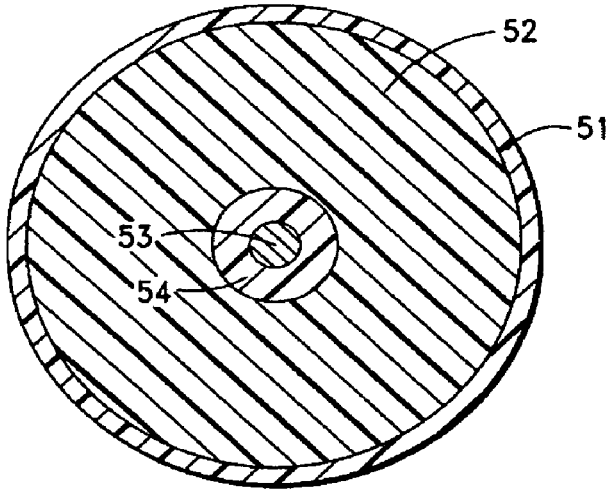
FIG. 6 is a sectional view of another exemplary embodiment of the electrically conductive buoyant cable in accordance with this invention.

FIG. 6 shows a sectional view of the electrically conductive buoyant cable of the current invention in yet another embodiment. In this embodiment, the conductor (53) is located at the central axis of the cable. The fiber layer (54) surrounds the conductor (53). It is also located on the central axis of the cable. When the cable is subjected to external forces, the conductor (53) and the fiber layer (54) mainly withstand the tension force along the central axis and also the bending stress is calculated by $\sigma$ ($\sigma$=MY/I, where M is the moment at the neutral axis, Y is the perpendicular distance to the neutral axis and I is the area moment of inertia about the neutral axis.). The conductor (53) and the fiber layer (54) are located on the neutral axis of the electrically conductive buoyant cable, the Y is zero or very close to zero, therefore the value of $\sigma$ is about 0. The electrically conductive buoyant cable can withstand a great bending force or a small bending radius. The electrically conductive buoyant cable will not be damaged easily. The problem of layer separation will not occur easily among the conductor (53), fiber layer (54), filler layer (52) and jacket (51).

Figure 7:
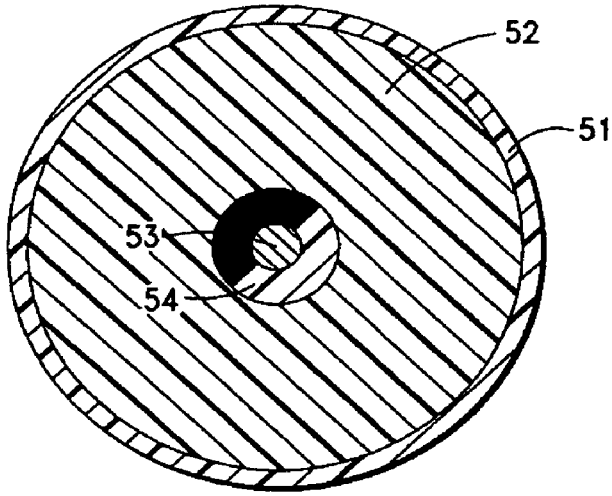
FIG. 7 is a sectional view of another exemplary embodiment of the electrically conductive buoyant cable in accordance with this invention in the third embodiment.

FIG. 7 shows a sectional view of the electrically conductive buoyant cable of this invention in another embodiment. In this embodiment, the fiber layer is twined surrounds the conductor (53). The twining angle will be set according to the production design and the tension resistance capability of the cable. In this embodiment, the conductor (53) is a single electrical wire or a set of wires or grouping of wires. In the prior art, the conductors are made from copper. Copper has a lower resistance than aluminum, and conductivity 1.6 times greater than aluminum. However, copper has a relative density 3.3 times greater than aluminum. The cable of the invention requires a lower density and good flexibility to lower the consummation of electrical power by the pool cleaning device. Consequently, aluminum is chosen in an exemplary embodiment.

In another embodiment, there are two or more sets of conductors in the cable of this invention. Consequently, insulation between two conductors becomes an issue. In known such cables, plastic material is used to enclose the conductor. The conductor is placed at the central axis of the cable. Infusible materials are located at or around the central axis. When plastic material is used to enclose the conductor, the infusible materials will be pushed away from the central axis of the electrically conductive buoyant cable because of the thick insulating layer.

In one embodiment of the cable of the invention herein, there are two or more groups of conductors, and insulation is added to the outer layer of every group of conductors. The insulation is not thicker than 0.1 mm. The binding force between the conductor and the insulation is much greater than between the conductor and the insulating plastic material surrounding the conductor. The plastic insulating layer is rather thick and does not fuse well with the conductor. Infusible and rigid metal material cannot be located at or around the central axis of the cable. The insulation also reduces density of the cable as compared to that of the plastic material used as an insulating layer. Insulating oil is one material that is used to make the insulating coating. Many kinds of insulating oil can be chosen. For example, Diphenylethane.

In one embodiment of the cable in accordance with this invention, the jacket (51) and the filler layer (52) are made of the same material. It will be appreciated by those skilled in the art that the same two elements may also be made from different materials. In a preferred embodiment, the two elements are made from material having similar melting points. When the two elements have similar melting points, fusibility is promoted. By similar, it is meant that the difference between the melting points is not greater than 30 degree Celsius. In the embodiment where the two elements have similar melting points, they will have good fusibility, have great ability to resist tension and a low likelihood that there will be layer separation.

In another embodiment, the jacket (51) of the cable is made from a solid material. In cases where there is a problem related to foaming and filler material which affects waterproofing and the insulating feature is eliminated. The jacket (51) and the filler layer (52) have good fusibility preventing layer separation. The ability to resist tension from the cable of this embodiment increases.

The conductor (53) and the fiber layer (54) of this embodiment are located on the cable which improves the flexibility of the cable and reduces the effect of movement by the pool cleaning device within a relatively small working area.

While the foregoing detailed description has described several embodiments of the pool cleaning vehicle power cable in accordance with this invention, it is to be understood that the above description is illustrative only and not limiting of the disclosed invention. It will be appreciated there are also various modifications to the cable that are suitable for use in the exemplary embodiments discussed above and that there are numerous embodiments that are not mentioned but within the scope and spirit of this invention. Thus, the invention is to be limited only by the claims as set forth below.

What is claimed is:

1. An electrically conductive buoyant cable, comprising:

a first piece defining an electrical conductor;

a second piece defining a filler layer made of buoyant material, the filler layer surrounds the electrical conductor; and a third piece defining a jacket having a small amount of filler material, the jacket surrounding the filler layer;

the filler layer and the jacket made from the same material, the material being a foam material and the foam material including hollow glass micro spheres; and the cable having a relative density less than 1.

2. An electrically conductive buoyant cable, according to claim 1, in which the material of the jacket and the filler layer is plastic polyethylene, plastic polypropylene or soft plastic with shore hardness below A120.

3. An electrically conductive buoyant cable, according to claim 1, in which the foam material is filled with air bubbles.

4. An electrically conductive buoyant cable, according to claim 1, wherein the foam material has tiny holes.

5. An electrically conductive buoyant cable, according to claim 1, in which the electrical conductor is located at the center axis of the electrically conductive buoyant cable.

6. An electrically conductive buoyant cable, according to claim 5, wherein the electrical conductor includes two or more groups of conductors, an insulation layer surrounding each group of conductors, and the insulating layer is made of insulating oil.

7. An electrically conductive buoyant cable, according to claim 1, which includes a tension bearing fiber layer and wherein the fiber layer twines around the conductor located at the center axis of the electrically conductive buoyant cable.

8. An electrically conductive buoyant cable, according to claim 7, wherein the tensional fiber of the tension bearing fiber layer tightly twines around the conductor.

9. An electrically conductive buoyant cable, according to claim 1, in which the electrical conductor is made of aluminum.

* * * * *